US006216020B1

(12) United States Patent
Findikoglu

(10) Patent No.: US 6,216,020 B1
(45) Date of Patent: Apr. 10, 2001

(54) LOCALIZED ELECTRICAL FINE TUNING OF PASSIVE MICROWAVE AND RADIO FREQUENCY DEVICES

(75) Inventor: Alp T. Findikoglu, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 09/163,734

(22) Filed: Sep. 30, 1998

Related U.S. Application Data

(63) Continuation-in-part of application No. 08/656,537, filed on May 31, 1996, now abandoned.

(51) Int. Cl.[7] ..... H01P 1/203; H01P 7/08; H01B 12/06

(52) U.S. Cl. ..... 505/210; 505/700; 505/701; 505/866; 333/99.005; 333/205; 333/235

(58) Field of Search ..... 333/995, 204, 333/205, 219, 235; 305/210, 700, 701, 866

(56) References Cited

U.S. PATENT DOCUMENTS 5,451,567 * 9/1995 Das ..... 333/995 X
5,472,935 * 12/1995 Yandrofski et al. ..... 333/995 X
5,538,941 7/1996 Findikoglu et al. ..... 505/210
5,604,375 2/1997 Findikoglu et al. ..... 257/661
5,694,134 * 12/1997 Barnes ..... 333/161 X
5,965,494 * 10/1999 Terashima et al. ..... 333/219 X

* cited by examiner

*Primary Examiner*—Benny T. Lee
(74) *Attorney, Agent, or Firm*—Milton D. Wyrick

(57) ABSTRACT

A method and apparatus for the localized electrical fine tuning of passive multiple element microwave or RF devices in which a nonlinear dielectric material is deposited onto predetermined areas of a substrate containing the device. An appropriate electrically conductive material is deposited over predetermined areas of the nonlinear dielectric and the signal line of the device for providing electrical contact with the nonlinear dielectric. Individual, adjustable bias voltages are applied to the electrically conductive material allowing localized electrical fine tuning of the devices. The method of the present invention can be applied to manufactured devices, or can be incorporated into the design of the devices so that it is applied at the time the devices are manufactured. The invention can be configured to provide localized fine tuning for devices including but not limited to coplanar waveguides, slotline devices, stripline devices, and microstrip devices.

26 Claims, 8 Drawing Sheets

LOCALIZED ELECTRICAL FINE TUNING OF PASSIVE MICROWAVE AND RADIO FREQUENCY DEVICES

This is a continuation-in-part application out of U.S patent application Ser. No. 08/656,537, filed May 31, 1996, now abandoned.

This invention was made with government support under Contract No. W-7405-ENG-36 awarded by the U.S. Department of Energy. The Government has certain rights in the invention.

FIELD OF THE INVENTION

The present invention generally relates to the things of passive microwave and RF devices, and, more specifically to localized electrical fine tuning of these devices.

BACKGROUND OF THE INVENTION

Often, in applications involving microwave/RF circuitry, it is necessary to tune the electrical characteristics of certain parts of the circuitry after it has been manufactured. Actually, with high-performance devices, such as high-Q microwave/RF resonators and several-pole microwave/RF filters, continual fine tuning often is required even after the initial tuning. Currently, both the initial tuning, and the subsequent fine tuning are achieved almost exclusively by mechanical means such as tuning screws, or by adding or removing wire-bonding from tuning pads placed on critical parts of the circuitry. This mechanical tuning is time consuming, and is found to be lacking in the area of controllability, accuracy and resolution.

Bulk ferrite materials also have been utilized for magnetically tunable microwave devices whose response can be tuned by applying a dc magnetic field. However, tunable and adaptive devices incorporating ferrites so far have had limited use due to their high unit cost, complexity, large size, high insertion loss, and low tuning speed.

The invention disclosed herein is related loosely to two previous issued to the inventor herein. These patents are: U.S. Pat. No. 5,538,941, issued Jul. 26, 1996, for SUPERCONDUCTOR/INSULATOR METAL OXIDE HETEROSTRUCTURE FOR ELECTRICALLY TUNABLE MICROWAVE DEVICES; and U.S. Pat. No. 5,604,375, issued Feb. 18, 1997, for SUPERCONDUCTING ACTIVE LUMPED COMPONENT FOR MICROWAVE DEVICE APPLICATION.

If possible, a way of tuning circuitry electrically which could be implemented in conventional planar microwave and RF circuitry with minimal modification in design and with negligible pertubation of device performance would be far superior to the conventional tuning regimes of the prior art. Tuning circuitry electrically also could provide a convenient means for adding adaptive features to the operation of the tuned device.

Electrical tuning of microwave/RF circuitry does provide many advantages over both mechanical and magnetic tuning. Among these advantages are convenience, reproducibility, controllability, versatility, speed, accuracy, resolution and adaptability. The method according to the present invention uses electric field induced changes in the permittivity of certain nonlinear dielectric thin film under specific bias configurations to effect electrical fine tuning of microwave/RF circuitry. The broad class of materials known as nonlinear dielectrics possess many characteristics which make them suitable for this application. Among these characteristics are high peak power capacity, short switching times, broadband capability, and easy integration into monolithic microwave/RF devices.

It is therefore an object of the present invention to provide apparatus and method for the localized electrical fine tuning of passive microwave and RF devices through local manipulation of the shunt and series capacitance of the devices.

It is another object of the present invention to provide apparatus and a general-purpose method for localized electrical fine tuning of conventional passive microwave and RF devices which provides improved speed, reproducibility and accuracy, without significant degradation of device performance.

It is yet another object of the present invention to provide apparatus and method for localized electrical fine tuning of conventional passive microwave and RF devices that can be incorporated into the devices either at the time of manufacture or after manufacture of the devices.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the combinations particularly pointed out in the appended claims.

SUMMARY OF THE INVENTION

To achieve the foregoing and other objects, a method of localized electrical fine tuning of a passive microwave or RF multiple element devices on a substrate, through the localized manipulation of either its shunt or series capacitance, comprising the steps of depositing nonlinear dielectric material onto a plurality of predetermined areas of the substrate in electrical contact with each of the multiple elements; depositing electrically conductive material onto a plurality of predetermined areas of the dielectric material and of the substrate, and forming electrodes; and applying individual, adjustable bias voltages to the electrodes.

In another aspect of the present invention there is provided an electrically fine tunable passive microwave or RF multiple element device comprising a multiple element passive microwave or RF device on a substrate with a nonlinear dielectric material on predetermined areas of the substrate and in electrical contact with each of the multiple elements. An electrically conductive material is on predetermined areas of the dielectric material and the substrate, and forms electrodes, with individual, adjustable bias voltages to applied to the electrodes.

In yet another aspect of the present invention there is provided a method of providing localized electrical fine tuning to a previously manufactured multiple element passive microwave or RF device on a substrate comprising the steps of depositing nonlinear dielectric material onto a plurality of predetermined areas of the substrate and in electrical contact with the multiple elements; depositing electrically conductive material onto a plurality of predetermined areas of the dielectric material and of the substrate, and forming electrodes; and applying individual, adjustable bias voltages to the electrodes.

In still another aspect of the present invention there is provided a method of manufacturing a multiple element passive microwave or RF device that provides localized electrical fine tuning comprising the steps of depositing an electrically conductive material onto a substrate at a plurality of predetermined positions to form multiple elements for the passive microwave or RF device desired; depositing nonlinear dielectric material onto the substrate at a plurality of predetermined areas and in electrical contact with each of the multiple elements; depositing electrically conductive material onto a plurality of redetermined areas of the dielectric material and of the substrate, and forming electrodes; and applying individual, adjustable bias voltages to the electrodes.

In still another aspect of the present invention there is provided an electrically fine tunable microwave or RF device comprising a multiple element passive microwave or RF device on a substrate with first contact pads and first resistive and inductive lines in electrical contact located at predetermined areas of the substrate, each of the first resistive and inductive lines terminating in a capacitive plate located a predetermined distance from a first end of each of the multiple elements. Second contact pads and second resistive and inductive lines are in electrical contact and are located at predetermined areas of the substrate, the second resistive and inductive line terminating in electrical contact with a second end of each of the multiple elements. A nonlinear dielectric material is deposited onto predetermined areas of the first end of each of the multiple elements and each of the capacitive plates, and individual, adjustable bias voltages are connected to each of the first and second contact pads.

In still another aspect of the present invention there is provided a method of providing localized electrical fine tuning to a previously manufactured multiple element passive microwave or RF device on a substrate comprising the steps of depositing a plurality of first contact pads and a plurality of first resistive and inductive lines onto predetermined areas of the substrate, each of the plurality of first contact pads and each of the plurality of first resistive and inductive lines being in electrical contact, with each of the first resistive and inductive lines terminating in a capacitive plate located at a predetermined distance from a first end of each of the multiple elements; depositing a plurality of second contact pads and a plurality of second resistive and inductive lines onto predetermined areas of the substrate, each of the plurality of second resistive and inductive lines terminating in electrical contact with a second end each of the multiple elements; depositing a plurality of nonlinear dielectric films onto predetermined areas of the first end of each of the multiple elements and each of the plurality of capacitive plates; and applying a plurality of individual, adjustable bias voltages between each of the pluralities of first and second contact pads.

In a still further aspect of the present invention there is provided a method of manufacturing a multiple element passive microwave or RF device that provides localized electrical fine tuning comprising the steps of depositing an electrically conductive material onto a substrate at a plurality of predetermined positions to form multiple elements for the passive microwave or RF device desired; depositing a plurality of first contact pads and a plurality of first resistive and inductive lines onto predetermined areas of the substrate, each of the plurality of first contact pads and each of the first resistive and inductive lines being in electrical contact, and each of the first resistive and inductive lines terminating at a predetermined distance from a first end of each of the multiple elements; depositing a plurality of second contact pads and a plurality of second resistive and inductive lines onto the substrate, each of the plurality of second contact pads and each of the second resistive and inductive lines being in electrical contact, and each of the second resistive and inductive lines terminating in electrical contact with a second end of each of the multiple elements; depositing a plurality of nonlinear dielectric films onto predetermined areas of the first end of each of the multiple elements and each of the capacitive plates; and applying a plurality of individual, adjustable bias voltages between each of the first and second contact pads.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 1 is a schematical illustration of one embodiment of the present invention in which a conventional multi-pole coplanar waveguide filter device structure is modified with gaps in the groundplanes which do not significantly perturb the microwave performance but allow for low-frequency fine-tuning of different areas of the device independently.
with:

FIG. 1 is a schematical illustration of one embodiment of the present invention that allows independent low-frequency fine tuning of different areas of the device.

FIG. 2 is a top view of a coplanar waveguide, the cross-section of which is illustrated in FIG. 1, clearly showing the arrangement of an arbitrary number of groundplanes positioned at predetermined locations of the nonlinear dielectric layer and showing the gaps between each groundplane and between the groundplanes and the device's centerline.
with:

FIG. 2 is top view of the device illustrated in FIG. 1 clearly showing arrangement of the groundplanes.

FIG. 3 is a schematic illustration of the electrical configuration of the coplanar waveguide illustrated in FIGS. 1 and 2 showing electrical lengths as well as coupling capacitances which can be fine tuned through the application of bias voltages.
with:

FIG. 3 is a schematic illustration of the electrical configuration of the device illustrated in FIGS. 1 and 2.

FIG. 8 is a side view of another embodiment of the invention in which a coplanar waveguide is configured with the signal line and ground planes deposited onto a substrate, with the nonlinear dielectric film deposited over the signal line and groundplanes.
with:

FIG. 8, is a side view of another embodiment of the present invention.

DETAILED DESCRIPTION OF THE INVENTION

Figure 1:
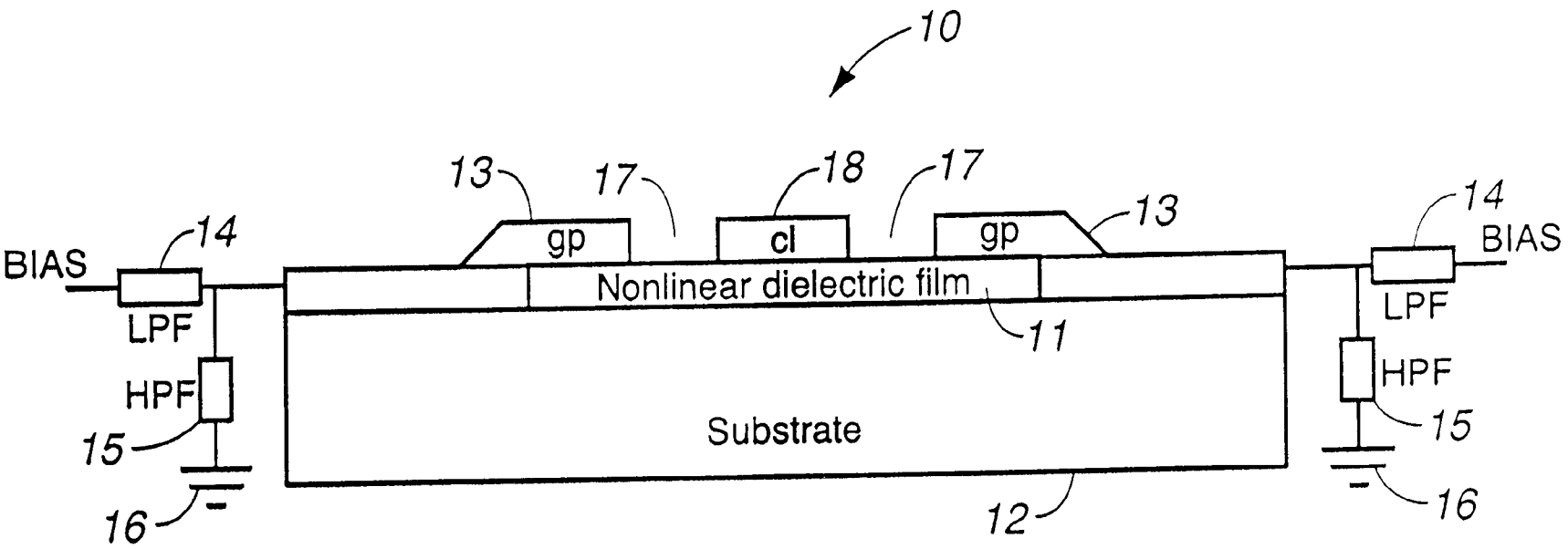

The primary purpose of the present invention is to provide a versatile electrical fine tuning method which is considerably superior to the conventional mechanical tuning methods used for passive microwave/RF multiple element devices, such as multi-pole filters. To achieve this fine electrical tuning, the present invention modifies the devices to allow for local fine-tuning and uses nonlinear dielectric thin films and bias electrodes deposited in specific bias configurations which do not degrade the microwave/RF performance of the device to which it is applied. This modification, which provides for manipulation of either the device's shunt or series capacitance, can occur at the design stage, prior to the manufacture of the device, or can be applied to manufactured devices, should it be necessary.

Reference numbers used in the drawings may be repeated in subsequent drawings when they refer to the same item in prior drawings that have been described in the specification. Because of this, certain items may not be re-identified in the discussion of a subsequent drawing if they have previously been so identified.

According to the present invention, a bias signal is applied to certain predetermined areas of the device that controls the permittivity of a nonlinear dielectric thin film in the region where the bias induces an electric field. The invention can be understood more easily from reference to the drawings.

In FIG. 1, a diagrammatic cross-sectional side view of one embodiment of the invention is illustrated in which the invention is integrated into a coplanar waveguide 10. As shown, nonlinear dielectric film 11 is deposited over substrate 12 in certain predetermined areas, the process of which will be explained more fully below. In this embodiment, the bias electrodes are ground planes (gp) 13, which then are deposited over nonlinear dielectric film 11 with specific gaps in those regions where control of the permittivity of nonlinear dielectric film 11 is desired, as will be more clearly shown in FIG. 2. A low-frequency bias voltage is applied through low pass filters (LPF) 14, with high frequency signals shunted to ground 16 through high pass filters (HPF) 15. The configuration shown in FIG. 1 is only one of many methods of applying the present invention so that it is effective in fine tuning passive microwave and RF devices without perturbing their efficacy. In other embodiments, the order of deposition could be in any desired order, as long as the bias electrodes, like groundplanes 13, are in contact with nonlinear dielectric film 11.

The nonlinearity of dielectric constant, $\in$, of dielectric layer 11 leads to facile fine tuning of microwave/RF devices under appropriate bias voltages through manipulation of the shunt or series capacitance of coplanar waveguide 10 or other similar multielement device. Signal line (cl) 18 and ground planes 13 are comprised of electrically conductive materials, and in some applications superconducting materials can be used to minimize conductor losses. For any electrically conductive material used for signal line 18 and ground planes 13, it will be necessary to verify the compatibility of the electrically conductive material with the particular nonlinear dielectric being used. In certain situations, a buffer layer between ground planes 13 and nonlinear dielectric film 11 may be required. Possible candidates for the electrically conductive material include normal conductors platinum, gold, or copper. Possible candidates for the applicable superconducting materials include low-temperature superconductors such a Nb or NbN, and high-temperature superconductors such as Y—Ba—Cu—O (YBCO) specifically $YBa_2Cu_3O_{7-x}$ ($0 \leqq x \leqq 0.5$), or Tl—BA—Ca—Cu—O (TBCCO).

Figure 2:
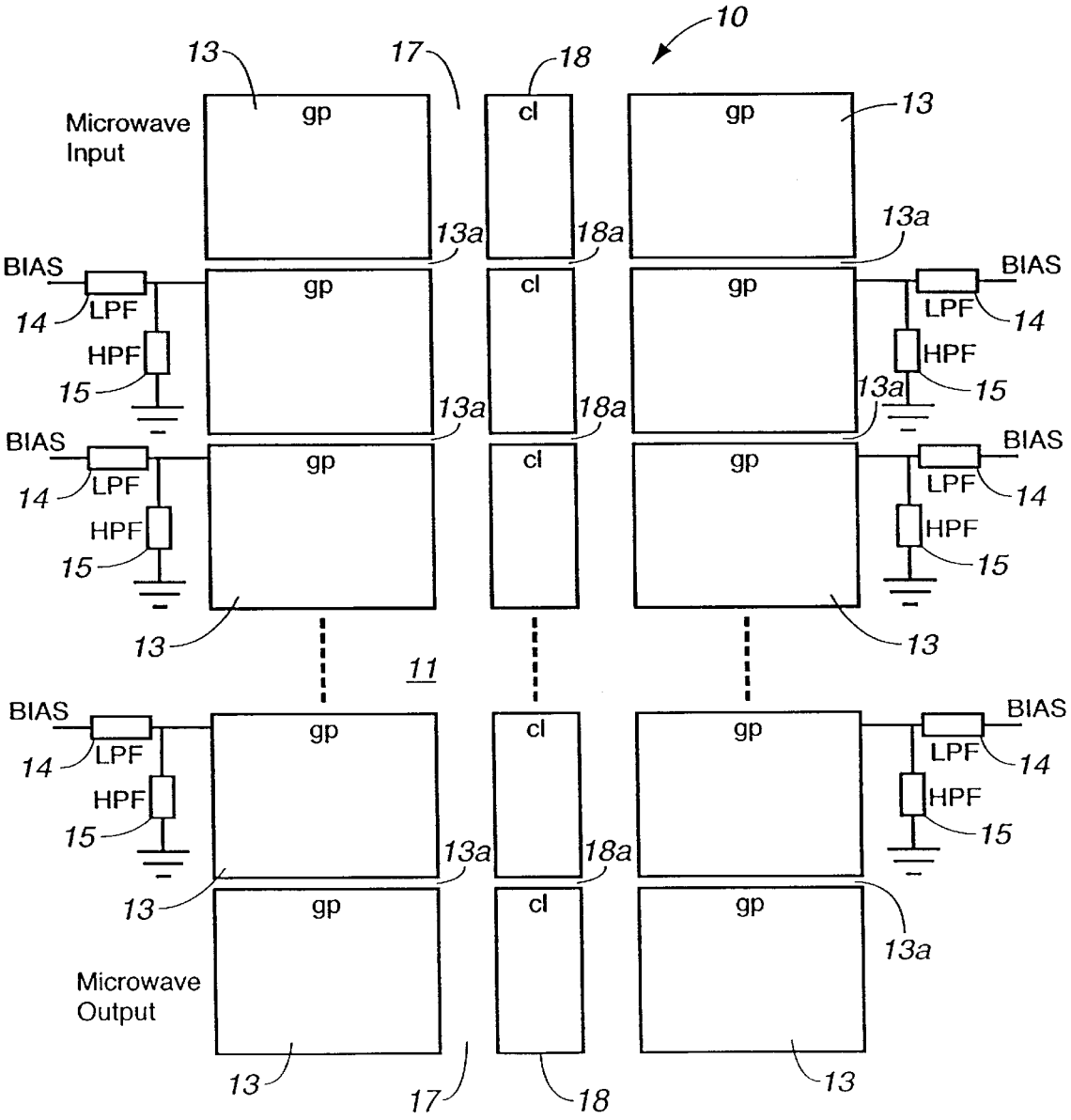

A top view of coplanar waveguide 10 of FIG. 1 is illustrated in FIG. 2. Here, an arbitrary number of segmented groundplanes gp 13 are shown formed by gaps 13*a* on nonlinear dielectric film 11, with each ground plane 13, except for groundplanes 13 at microwave input and microwave output, being biased through low pass filter 14 and high pass filter 15. Gaps 13*a* between ground planes 13 are approximately 2 $\mu$m wide, and are chosen so that high frequency signals propagate along segments of ground planes 13 with little pertubation. As shown schematically, gaps 17 (also shown in FIG. 1) between groundplanes 13 and signal line (cl) 18 are much larger than gaps 13*a* between adjacent groundplanes 13. This assures that the additional gaps 13*a* applied by the present invention will not affect the high frequency performance of coplanar waveguide 10 or any other device with which it is employed. Also illustrated are gaps 18*a* between signal line 18 segments. Gaps 18*a* can range in width between approximately 1 $\mu$m and 10 s of $\mu$m, and are a function of the design of the multiple element devices and their intended application.

Figure 3:
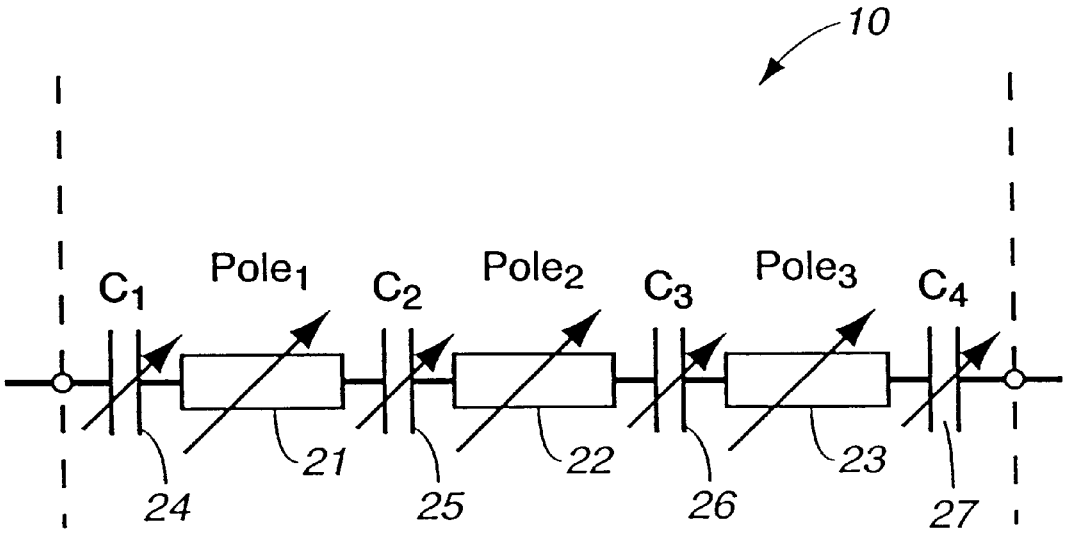
Figure 4:
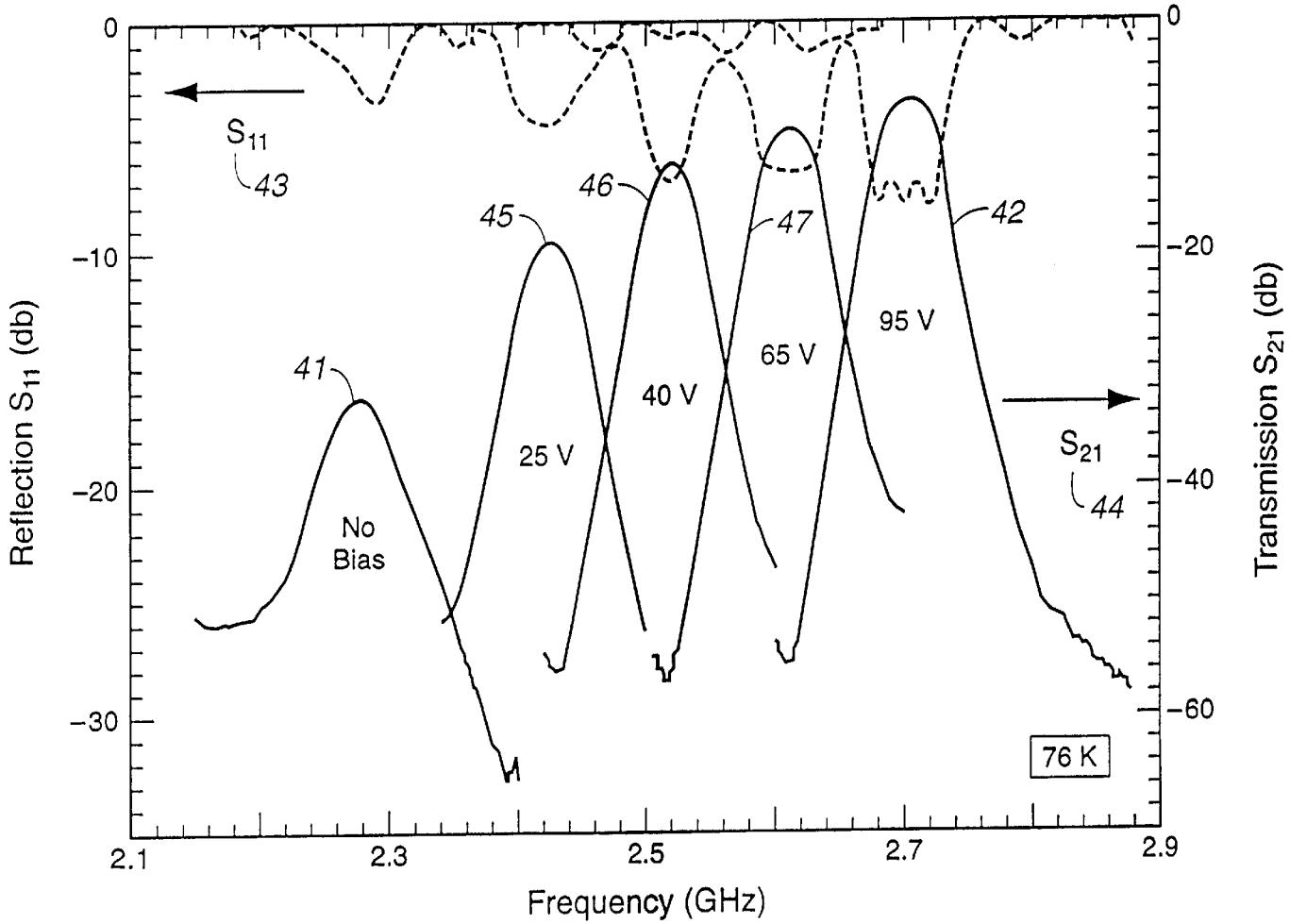
FIG. 4 is a plot showing fine-tuned microwave reflection, $S_{11}$, and transmission, $S_{21}$, versus frequency for several average bias voltages applied to each pole of a coplanar waveguide 3-pole bandpass filter operating at a temperature of 4 K.

The generic tunable coplanar waveguide 10 shown in FIGS. 1 and 2, can, for example, be configured as a standard multi-pole half-wave bandpass filter. In that configuration, dielectric layer 11 can be approximately 1.2 $\mu$m thick, and gaps 13*a* between adjacent groundplanes 13 can be approximately 0.4 $\mu$m thick. Dielectric film 11, in one embodiment illustrated in FIGS. 3 and 4 is paraelectric $Sr_3TiO$ (e.g. $Sr_{1-x}Ba_xTiO_3$, where $0 \leqq x \leqq 1$), and ground plane 13 is high temperature superconductor Y—Ba—Cu—O. However, dielectric film 11 could be any appropriate nonlinear dielectric material. Similarly, groundplanes 13 and signal line 18 for superconducting applications could be any suitable high or low temperature superconductor. For room temperature applications ground planes 13 and signal line 18 could be any normal electrically conductive material. Substrate 12 can comprise $LaAlO_3$, although any other suitable substrate material could be used.

As illustrated in FIGS. 1 and 2, coplanar waveguide 10 defines gaps 17, which are approximately 30 $\mu$m wide, between ground plane 13 and signal line 18, and gaps 13*a* between adjacent ground planes 13. These gaps 17, 13*a* allow biasing of dielectric layer 11 at predetermined areas of dielectric layer 11, shown in FIG. 2 at points BIAS-1 through BIAS-4 and BIAS-M-1 and BIAS-M along with associated low pass filters 14 and high pass filters 15, but are sized so that they do not degrade passing microwave fields. This nondegradation is due to the fact that the capacitance of gaps 17 is much smaller than the capacitance of gaps 13*a*.

These modifications to the conventional coplanar waveguide allow the electrical fine tuning of the dielectric constant, $\in$, of dielectric layer 11 at different locations within coplanar waveguide 10 without significantly affecting the performance of coplanar waveguide 10. As schematically illustrated in FIG. 3, this effectively allows the independent fine tuning of each of the poles 21 (pole 1), 22 (pole 2) and 23 (pole 3), and of the coupling capacitances 24 ($C_1$), 25 ($C_2$), 26 ($C_3$) and 27 ($C_4$) of coplanar waveguide 10.

FIG. 4 shows microwave reflection, $S_{11}$ 43, and transmission, $S_{21}$ 44, versus frequency for several average bias voltages, 25 V 45, 40 V 46, and 65 V 47. These average bias voltages, 25 V 45, 40 V 46, and 65 V 47, are the averages of varying biases individually applied to each pole 21, 22, and 23 of coplanar waveguide 10 (FIG. 3) operated at a temperature of 76 K (as shown in the frame in FIG. 4). For each average voltage applied, the filter profile was fine tuned by applying an optimized bias voltage to each segment of ground plane la (FIGS. 1 and 2).

As seen in FIG. 4, with no applied bias voltage 41 (No Bias in FIG. 4), the insertion of coplanar waveguide 10 causes high filter insertion loss and the profile is asymmetric. Upon the application of bias voltages 45, 46, 47, the electrical lengths of poles 21, 22, and 23, and the capacitances 24, 2, and 2, (FIG. 3) can be varied and the filter profile can be fine tuned over a wide range. This clearly illustrates how the application of fine tuning bias voltages optimizes the filter profile.

In the device according to the present invention, the level of the bias voltage needed to effectuate tuning of the electrical lengths of poles 21, 22, and 23 (FIG. 3) is more than an order of magnitude greater than the bias voltage needed to fine tune the filter profile. Because of this, FIG. 4 illustrates only the average bias voltages for poles 21, 22, and 23, and not the bias voltages for capacitances 24, 25, and 26, although the fine tuning voltages are used to obtain a symmetric and optimized filter profile for poles 21, 22, and 23, and capacitances 24, 25, and 26.

As is shown in FIG. 4, at an average 95 V bias voltage 42, the reflection coefficient, $S_{11}$ 43, exhibits three distinct local minima (designated by the dashed curve) related to coupled resonances in the half-wave segments of coplanar waveguide 10. A simple simulation using similar data measured at 4 K yielded 0.5 dB/m attenuation loss for coplanar waveguide 10. This value can be interpreted as an upper limit for the dielectric loss under bias at 4 K, with a corresponding maximum effective loss tangent of $5\times10^{-4}$. It should be noted that the 95 V bias voltage 42 at 76 K corresponding to a peak transverse dc electric field of approximately $3\times10^{6}$ V/m in gaps 17 (FIG. 1), and the dc electric field falls off rapidly from the surface of dielectric layer 11 (FIG. 1) toward the back side of substrate 12.

For the fine tuning of coplanar waveguide 10, very thin dielectric layers 11 provide lower dielectric loss, and thus a superior filter profile. Work on the present invention has indicated that the use of thinner $SrTiO_3$ films as dielectric layers 11 (FIG. 1), as well as large dc bias voltages should reduce dielectric losses significantly. In addition, the required bias voltages can be reduced by designing coplanar waveguides 10 having smaller gaps 17.

Coplanar waveguide 10, according to the present invention is electrically tunable and adaptive. The three-pole band-pass filter configuration shown in FIG. 3 has a filter response centered around 2.6 GHz, having an approximate 2% bandwidth, and an adaptive range of greater than 15%. The bandwidth and insertion loss improve with increasing bias voltages and decreasing temperatures. At the temperature of liquid helium, and with 95 V bias voltage 42 (FIG. 4), coplanar waveguide 10 (FIG. 1) has an insertion loss of approximately 3 dB, and a return loss of approximately 27 dB at the center frequency of the passband.

Figure 5:
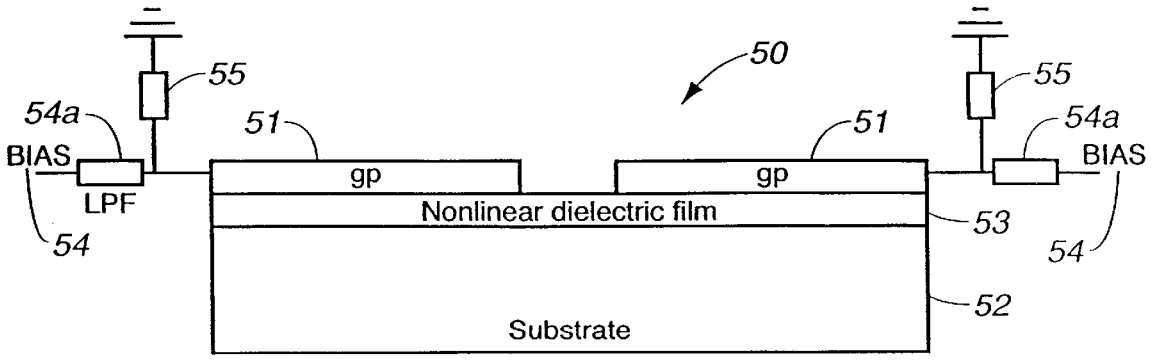
FIG. 5 is a schematical cross-sectional illustration of the layers involved in utilizing the present invention with a slotline device.

The present invention is not limited to coplanar waveguides. For example, another configuration of the invention is illustrated in FIG. 5, where slot line device 50 is shown comprising ground plane (gp) 51 deposited onto substrate 52. Nonlinear dielectric film layer 53 is deposited onto ground plane 51 and substrate 52. Similar to the bias voltage in FIG. 1, bias voltage 54 is applied to ground plane 51 through low pass filter (LPF) 54*a*, with high frequency components shunted to ground through high pass filter (HPF) 55. Gaps 13*a* (FIG. 2) between adjacent groundplanes 51 are not illustrated in FIG. 5, but are present in the device to allow localized fine tuning. Again, gaps 13*a* (not shown) between adjacent groundplanes 51 are sufficiently small as to provide high capacitance so that passing microwaves are not significantly perturbed.

Similar depositions of nonlinear dielectric films, centerlines, bias electrodes and ground planes can be used for most any passive microwave/RF device, including microstrip lines and strip lines to allow for electrical tuning of those devices.

Figure 6:
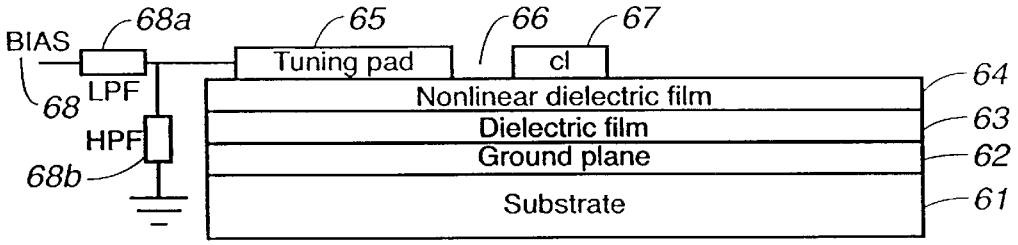
FIG. 6 is a schematical cross-sectional illustration of the layers involved in utilizing the present invention with a microstrip device.

FIG. 6 illustrated the deposition layers for a microstrip device wherein substrate 61 has groundplane layer 62 deposited over it. Dielectric film layer 63 is deposited over groundplane layer 62. Nonlinear dielectric film layer 64 is deposited over dielectric layer 63. Because, in a microstrip device, groundplane layer 62 is deep within the device, separate bias tuning pad electrodes 65 are deposited onto nonlinear dielectric layer EA at predetermined locations, and define a small gap 66 with signal line (C1) 67 and the same gaps between adjacent areas of nonlinear dielectric film layer 64 as are illustrated as gaps 22 in FIG. 2. It should be noted that bias electrodes 65 can be variously configured, as can nonlinear dielectric layer 64, as long as they are in physical contact with each other. In fact, for any type device nonlinear dielectric layer 64 could overlie signal line 67 and bias electrodes 65.

For a superconducting microstrip, bias electrodes 65 could also be a superconducting material. For a conventional microstrip, any electrically conductive material could be used as previously discussed. Bias voltage 68 is connected to bias electrodes 65 through low pass filter (LPF) 68*a*, with high frequency signals either floated or shunted to ground through high pass filter HPF 68*b* as shown in FIG. 6.

Figure 7:
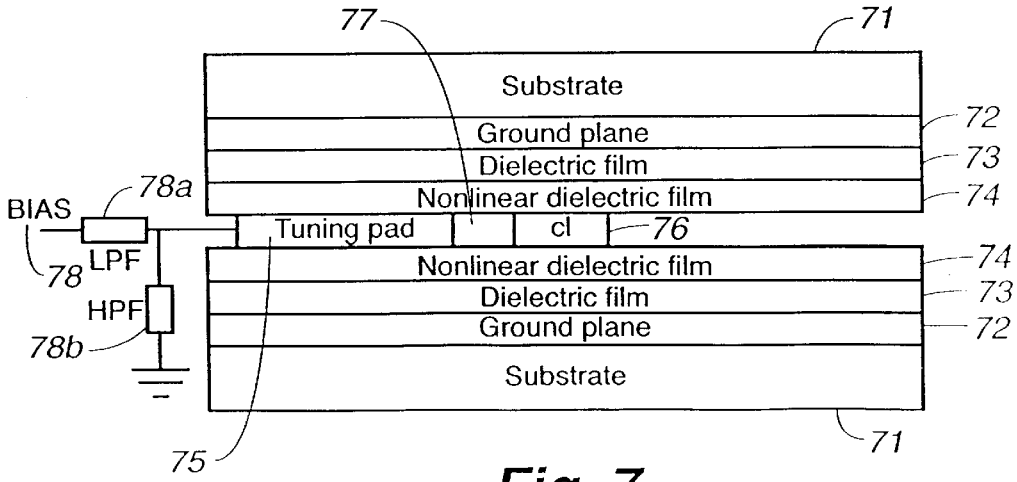
FIG. 7 is a schematical cross-sectional illustration of the layers involved in utilizing the present invention with a stripline device.

The configuration according to the present invention for a stripline device is shown in cross-section in FIG. 7. Here, it can be seen that identical mirrored arrangements of substrate 71, groundplane layer 72, dielectric film layer 73, and nonlinear dielectric layer 74. Lying between the two arrangements are bias electrodes 75 and signal line (C1) 76, with bias tuning pad electrodes 75 defining small gap 77 with signal line 76.

Once again, the actual arrangement of bias electrodes 75 and nonlinear dielectric layer 74 can realize numerous configurations which could have dielectric layer overlying bias electrodes 75, as well as signal line 76. Also, bias electrodes 75 again could be made of superconducting or normal conductive material depending on whether the stripline device is superconducting. Bias voltage 78, as before is connected to bias electrodes 75 with associated filter 78*a* (LPF), and optional filter 78 (HPF).

With the configurations of FIGS. 6 and 7, small gaps 66, 77, respectively, again are sufficiently small that relatively low bias voltages yield appreciable electric fields. However, small gaps 66, 77 are sufficiently wide to prevent significant pertubation of high frequency device performance.

Figure 8:
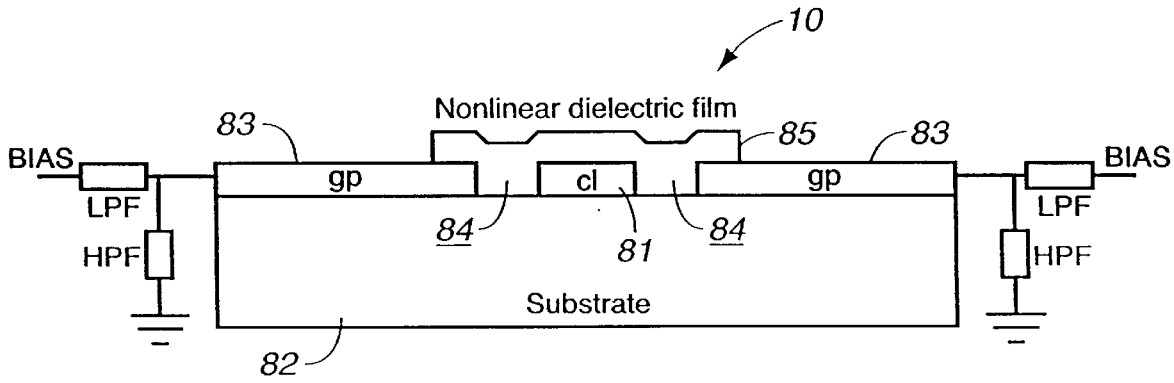

Another embodiment of coplanar waveguide 10 is illustrated in FIG. 8. As is shown, for this embodiment, signal line (C1) 81 is deposited directly onto substrate 82. Ground planes (gp) 83 also are deposited onto substrate 82 in predetermined areas, in close proximity to signal line 81, defining gap 84. Small gaps also are defined between each ground plane 83. Nonlinear dielectric film 85 is then deposited over signal line 81 and ground planes 83. In this embodiment, the predetermined areas of ground planes 83 contact the desired predetermined areas of nonlinear dielectric film 85. As in previous embodiments, bias voltage (BIAS) is provided to ground planes 83 through the combination of low pass filters (LPF) and high pass filters (HPF).

Again, in other embodiments, the order of deposition of the various layers could be in any desired order, as long as bias electrodes, like groundplanes 13, are in contact with nonlinear dielectric film 11, as depicted in FIG. 1.

Figure 9A:
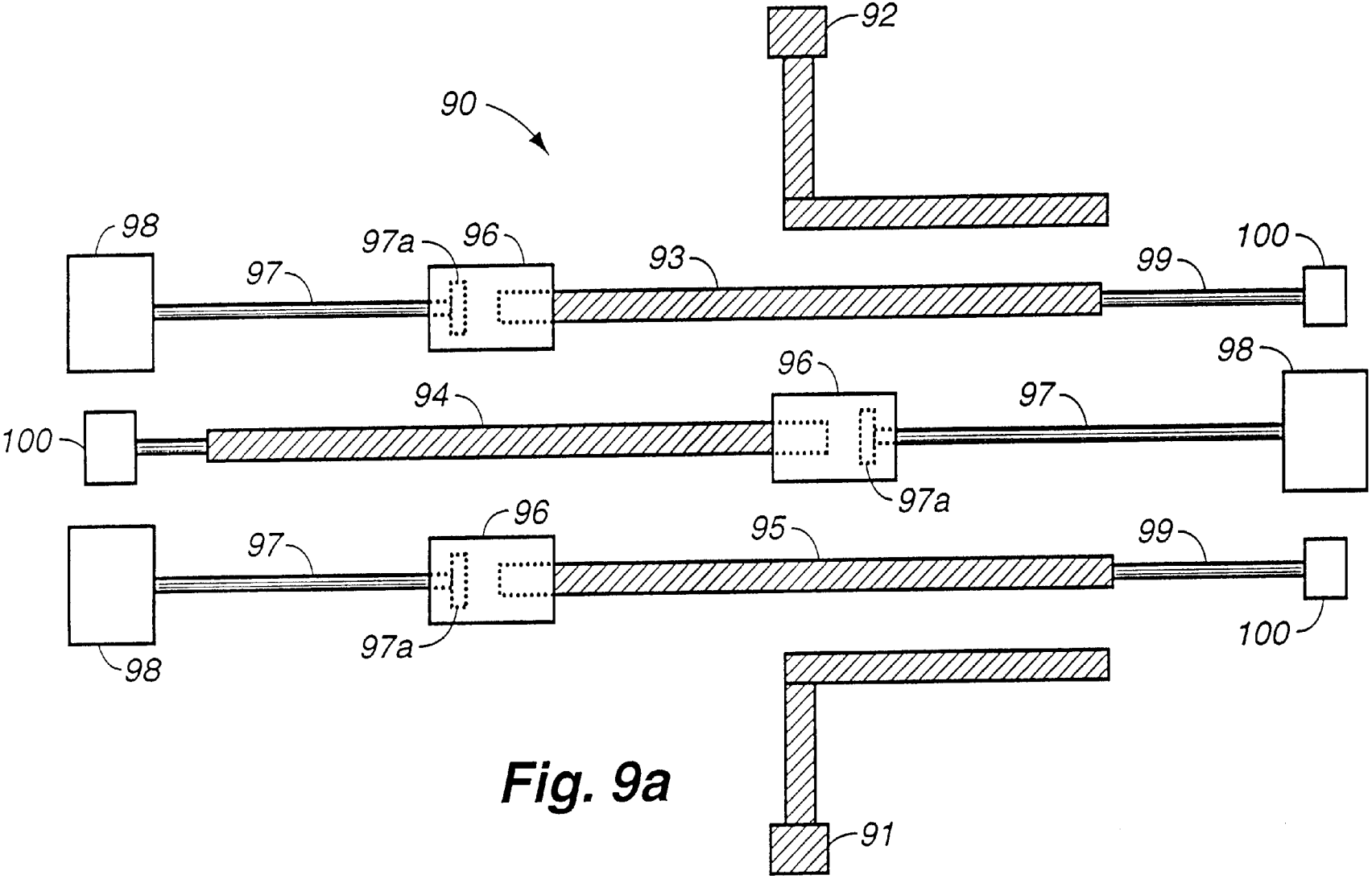
FIGS. 9A and 9B are schematical top and sectional views respectively of a 3-pole bandpass filter modified after manufacture for localized tuning.
Figure 9B:
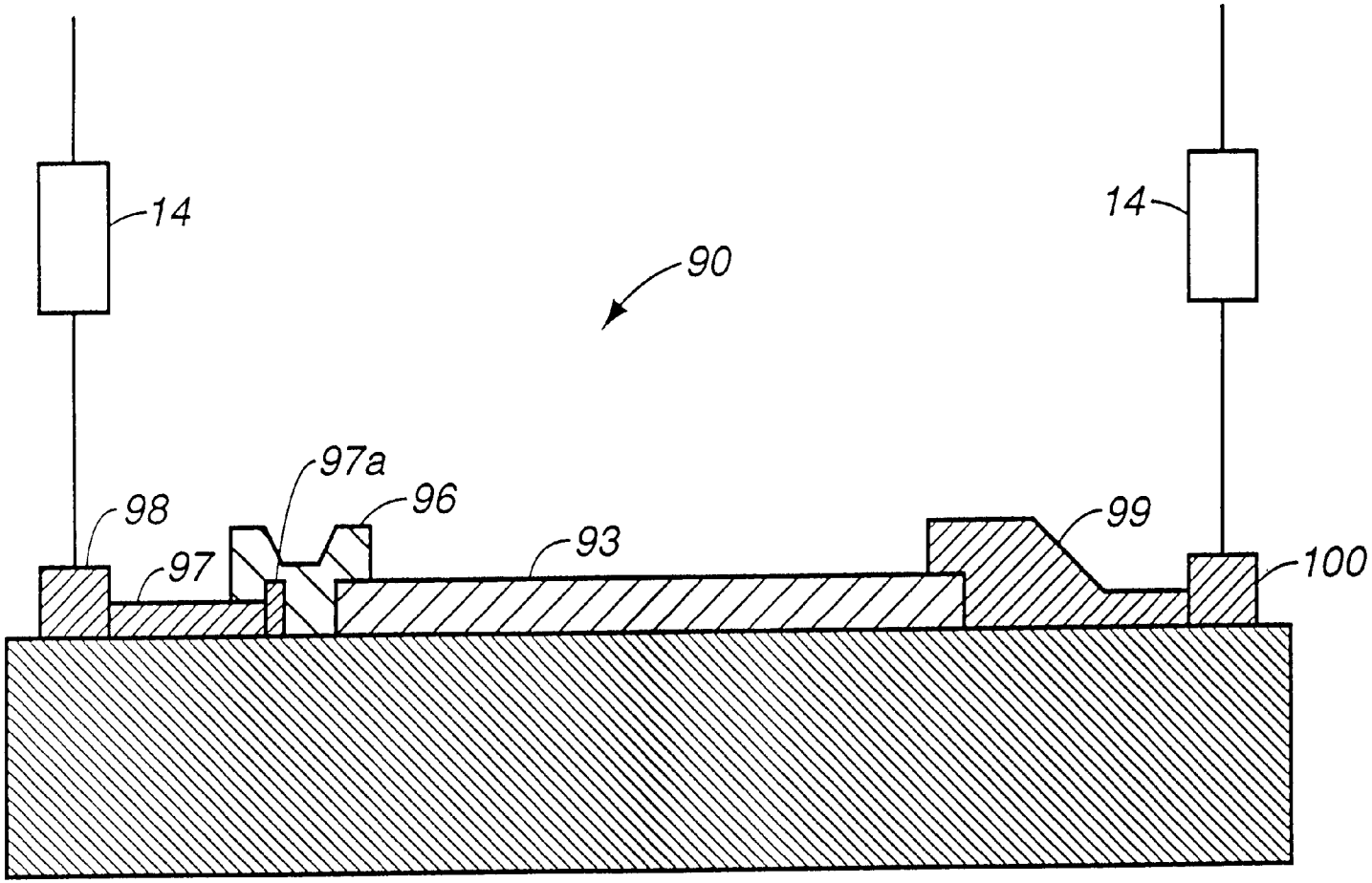

Still another embodiment of the invention is illustrated schematically in FIG. 9A, a top view, and FIG. 9B, a sectional side view. As seen in FIG. 9A an exemplary passive multiple element device 90, a, 3-pole bandpass, filter, is shown having input 91 and output 92, and electrically conductive resonant elements 93, 94, and 95. The importance of FIGS. 9A and B is the illustration of use of the invention to either add local fine tuning to a previously manufactured device or to a device at its design stage, prior to its manufacture.

As shown in FIG. 9A nonlinear dielectric material 96 is deposited in contact with each electrically conductive resonant elements 93, 94, and 95, as well as with electrically conductive material 97, its end segement 97*a*, and contact pad 98, to provide one pole of the individual bias voltages (shown in FIG. 9B). Resistive and inductive material 99 connects the opposite end of each electrically conductive resonant elements 93, 94, and 95 to contact pad 100 for the opposite pole of the individual bias voltages (shown in FIG. 9B).

A schematical sectional side view of device 90 along section line 9B is illustrated in FIG. 9B. In FIG. 9B, it is easier to see the deposition order and the cooperation of the various materials. In the manufacturing process electrically conductive resonant elements 93, 94, and 95 and inputs 91 and 92 would be deposited first. In a post manufacture situation, these elements would already be in place. Next, resistive and inductive material 99 and contact pads 98 and 100 are deposited to provide connection to the bias voltages. Finally, nonlinear dielectric material 96 is deposited from electrically conductive resonant elements 93, and elements 94, 95 (FIG. 9A) to connect with resistive and inductive material 99. As shown, contact pads 98 and 100 are connected through low pass filter 14 to the adjustable bias voltage.

The important point of the present invention is that it can be implemented in various ways in various devices so that it is applicable for most any multiple element passive microwave/RF device. The invention can be applied to an existing device to tailor its characteristics to meet certain criteria, but perhaps more effectively, could be incorporated into devices at the time of manufacture. In either case, the present invention allows for the precise localized fine tuning of passive devices so that they perform to their desired specifications. The intent of the invention remains constant in either regime to provide a novel method of localized fine tuning these devices through modification of the device structure and the control of the permittivity of nonlinear dielectric layers in certain predetermined areas.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of providing localized electrical fine tuning to a previously manufactured multiple element passive microwave or RF device on a substrate comprising the steps of:

depositing a plurality of first contact pads and a plurality of first resistive and inductive lines onto first predetermined areas of said substrate, each of said plurality of first contact pads and each of said plurality of first resistive and inductive lines being in electrical contact, and each of said first resistive and inductive lines terminating in a respective capacitive plate located at a predetermined distance from a first end of corresponding ones of said multiple elements;

depositing a plurality of second contact pads and a plurality of second resistive and inductive lines onto second predetermined areas of said substrate, each of said plurality of second resistive and inductive lines terminating in electrical contact with a second end of each of said multiple elements;

depositing a plurality of respective nonlinear dielectric films onto predetermined areas of said first end of each of said multiple elements and each of said plurality of respective capacitive plates; and applying a plurality of individual, adjustable bias voltages between each of said pluralities of first and second contact pads.

2. The method as described in claim 1 wherein said individual, adjustable bias voltages are applied between each of said pluralities of first and second contract pads through respective low pass filters.

3. The method as described in claim 1 wherein said electrically conductive material comprises an electrical conductor.

4. The method as described in claim 3 wherein said electrical conductor comprises platinum.

5. The method as described in claim 3 wherein said electrical conductor comprises gold.

6. The method as described in claim 3 wherein said electrical conductor comprises copper.

7. The method as described in claim 1 wherein said nonlinear dielectric material comprises a metal oxide based nonlinear dielectric material.

8. The method as described in claim 7 wherein said metal oxide based nonlinear dielectric material comprises $Sr_{1-x}Ba_xTiO_3$, where $0<x<1$.

9. The method as described in claim 1 wherein said electrically conductive material comprises a high temperature superconducting material.

10. The method as described in claim 9 wherein said high temperature superconducting material comprises $YBa_2Cu_3O_{7-x}$, where $0<x<0.5$.

11. The method as described in claim 1 wherein said electrically conductive material comprises a low temperature superconducting material.

12. The method as described in claim 11 wherein said low temperature superconducting material comprises NbN.

13. The method as described in claim 11 wherein said low temperature superconducting material comprises Nb.

14. A method of providing localized electrical fine tuning to a previously manufactured multiple element passive microwave or RF device on a substrate comprising the steps of:

depositing respective nonlinear dielectric material onto a plurality of predetermined areas of said substrate and in electrical contact with said multiple elements;

depositing respective electrically conductive material onto a plurality of predetermined areas of said dielectric material and of said substrate, and forming a plurality of electrodes; and applying individual, adjustable bias voltages to said plurality of electrodes.

15. The method as described in claim 14, wherein said individual, adjustable bias voltages are applied to each of said plurality of electrodes through respective low pass filters, and high frequency signals from said plurality of electrodes are shunted to ground through respective high pass filters.

16. The method as described in claim 14 wherein said electrically conductive material comprises a high temperature superconducting material.

17. The method as described in claim 16 wherein said high temperature superconducting material comprises $YBa_2CU_3O_{7-x}$, where $0<x<0.5$.

18. The method as described in claim 14 wherein said electrically conductive material comprises a low temperature superconducting material.

19. The method as described in claim 18 wherein said low temperature superconducting material comprises Nb.

20. The method as described in claim 18 wherein said low temperature superconducting material comprises NbN.

21. The method as described in claim 14 wherein said electrically conductive material comprises an electrical conductor.

22. The method as described in claim 21 wherein said electrical conductor comprises platinum.

23. The method as described in claim 21 wherein said electrical conductor comprises gold.

24. The method as described in claim 21 wherein said electrical conductor comprises copper.

25. The method as described in claim 14 wherein said nonlinear dielectric material comprises a metal oxide based nonlinear dielectric material.

26. The method as described in claim 25 wherein said metal oxide based nonlinear dielectric material comprises $Sr_{1-x}Ba_xTiO_3$, where $0<x<1$.

* * * * *